US006833665B2

(12) United States Patent
Wachi et al.

(10) Patent No.: US 6,833,665 B2
(45) Date of Patent: Dec. 21, 2004

(54) FLAT DISPLAY PANEL WITH A FRONT PROTECTION PLATE

(75) Inventors: Hiroshi Wachi, Ichihara (JP); Ken Moriwaki, Ichihara (JP); Takeomi Miyako, Ichihara (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 10/199,105

(22) Filed: Jul. 22, 2002

(65) Prior Publication Data

US 2003/0085649 A1 May 8, 2003

(30) Foreign Application Priority Data

Jul. 23, 2001 (JP) ..... 2001-221794
Aug. 13, 2001 (JP) ..... 2001-245176

(51) Int. Cl.[7] ..... H01J 29/88

(52) U.S. Cl. ..... 313/479; 313/112; 313/110; 313/582; 348/819; 348/835

(58) Field of Search ..... 313/110, 479, 313/112, 582–587, 466, 489, 313, 635, 478; 174/35 MS, 35 R; 359/350, 580; 348/819, 835; 315/85

(56) References Cited

U.S. PATENT DOCUMENTS 5,811,923 A * 9/1998 Zieba et al. ..... 313/479
5,834,122 A 11/1998 Teng et al.
6,104,530 A * 8/2000 Okamura et al. ..... 359/359
6,165,546 A 12/2000 Teng et al.
6,229,252 B1 5/2001 Teng et al.
6,344,710 B2 2/2002 Teng et al.
6,429,587 B1 * 8/2002 Sugimachi et al. ..... 313/582
6,452,331 B1 9/2002 Sakurada et al.
6,548,177 B2 * 4/2003 Hieda et al. ..... 428/441
6,621,003 B2 * 9/2003 Yoshida et al. ..... 174/35 MS

FOREIGN PATENT DOCUMENTS

| | | |
|---|---|---|
| EP | 0 886 295 | 12/1998 |
| EP | 0 908 920 | 4/1999 |
| JP | 57-21458 | 2/1982 |
| JP | 57-198413 | 12/1982 |
| JP | 60-43605 | 3/1985 |
| JP | 11-119666 | 4/1999 |
| JP | 2000-172182 | 6/2000 |
| JP | 2001-13877 | 1/2001 |

OTHER PUBLICATIONS

U.S. patent application Ser. No. 09/234,314, filed Jan. 21, 1999, pending.
U.S. patent application Ser. No. 10/023,290, filed Dec. 20, 2001, pending.
U.S. patent application Ser. No. 10/119,839, filed Apr. 11, 2002, pending.
U.S. patent application Ser. No. 10/187,633, filed Jul. 3, 2002, pending.
U.S. patent application Ser. No. 10/176,604, filed Jun. 24, 2002, pending.
U.S. patent application Ser. No. 10/176,683, filed Jun. 24, 2002, pending.

(List continued on next page.)

*Primary Examiner*—Edward J. Glick
*Assistant Examiner*—Elizabeth Keaney
(74) *Attorney, Agent, or Firm*—Oblon, Spivak, McClelland, Maier & Neustadt, P.C.

(57) ABSTRACT

A flat display panel comprising a flat display panel main body, and a front protective plate which comprises an antireflection layer, a translucent electrically conductive layer, containing a metal having an electromagnetic wave shielding property and a near infrared ray shielding property, a highly rigid transparent substrate made of a tempered glass or a semi-tempered glass and an adhesive layer laminated in this order, bonded to the viewer's side surface of the flat display panel main body by means of the adhesive layer.

12 Claims, 1 Drawing Sheet

OTHER PUBLICATIONS

U.S. patent application Ser. No. 10/199,105, filed Jul. 22, 2002, pending.
U.S. patent application Ser. No. 10/222,774, filed Aug. 19, 2002, pending.
U.S. patent application Ser. No. 10/235,487, filed Sep. 6, 2002, pending.
U.S. patent application Ser. No. 10/251,846, filed Sep. 23, 2002, pending.
U.S. patent application Ser. No. 10/305,194, filed Nov. 27, 2002, pending.
Patent Abtracts of Japan, JP 11–344935, Dec. 14, 1999.
Patent Abtracts of Japan, JP 2000–250420, Sep. 14, 2000.

* cited by examiner

FLAT DISPLAY PANEL WITH A FRONT PROTECTION PLATE

BACKGROUND OF INVENTION

1. Field of Invention

The present invention relates to a flat display panel having such a structure that a front protective plate is unitedly bonded to the viewer's side surface of a flat display panel main body so as to improve mechanical strength of the flat display panel particularly plasma display panel (hereinafter referred to simply as PDP) main body to prevent breakage, and to decrease electromagnetic noises and near infrared rays generated from the flat display panel main body.

2. Discussion of the Background Art

In recent years, PDP having such advantages that a large screen panel can be prepared and clear full color display can be given, has attracted attention. PDP is to provide a full color display in such a manner that a phosphor is selectively discharged to emit light in a large number of discharge cells isolatedly formed between two glass plates. From this principle of emission, electromagnetic waves and heat radiation (near infrared rays) to be a factor in malfunction of other devices or generation of noises are discharged from the front of PDP, and accordingly it is required to shield such electromagnetic waves and heat radiation.

Heretofore, the following has been known to impart a function to cut electromagnetic waves and heat radiation (near infrared rays) to the flat display panel main body.

(A) JP-A-11-119666 discloses a display panel comprising a PDP main body, an electromagnetic wave shielding material bonded to the front of the PDP main body by means of a transparent adhesive, a transparent substrate bonded to the front of the electromagnetic wave shielding material by means of a transparent adhesive, and a heat radiation cutting layer provided between the transparent substrate and the PDP main body. As the electromagnetic wave shielding material, an electrically conductive mesh made of metal fibers or metal-coated organic fibers is used, and as the heat radiation cutting layer, a multilayer film comprising a base film and an oxide transparent electrode film and a metal thin film alternately laminated on the base film, is used.

(B) JP-A-57-21458, JP-A-57-198413, JP-A-60-43605, etc., disclose an optical filter provided with a near infrared ray shielding layer made of a resin composition obtained by dispersing an additive having a near infrared ray absorption property (near infrared ray absorbent) in a binder resin. A near infrared ray shielding layer having such a construction is easily formed, and its material is available at a relatively low cost.

(C) JP-A-2001-13877 discloses a flat display device comprising a PDP main body and an optical filter comprising a visible light reflectance adjusting layer, an impact-relieving component and a component which adjusts the color, shields radiation electromagnetic waves, and shields near infrared rays as well, disposed and bonded to the display side substrate of the PDP main body.

However, among the above-described prior arts, in (A), since an electrically conductive mesh is used as the electromagnetic wave shielding material, if the numerical aperture of the mesh is lowered to increase the electromagnetic wave shielding property, the mesh tends to shield light emitted from the PDP main body, whereby the light transmittance tends to decrease, and the clarity of the image may be impaired, and if the numerical aperture of the mesh is increased, although the light transmittance improves, the electromagnetic wave shielding property tends to deteriorate.

In the case where a near infrared ray shielding layer comprising a near infrared ray absorbent as in (B) is applied to the front protective plate to be unitedly bonded to the PDP main body, no near infrared ray shielding effect as designed may be obtained. For example, in the construction as disclosed in JP-A-11-119666, if a near infrared ray shielding layer employing a near infrared ray absorbent is provided instead of the heat radiation cutting film employing a metal material, the near infrared ray shielding property or the color tone of the transmitted light may change as before and after long-term lighting, such being disadvantageous.

In (C), the optical filter part to be bonded to the PDP main body is provided with the impact-relieving material made of e.g. a urethane resin type material which is transparent and has impact resistance, or an acrylic resin type material containing an acryl rubber type material, such being effective for prevention of scratches. However, the rigidity of the optical film itself can not be increased with such a resin layer, and if an external force is applied from the viewer's side, the external force is applied to a front glass of the PDP main body, and the PDP main body may not sufficiently be protected.

Further, in a flat display panel such as PDP, if the front protective plate itself bonded to the front of the flat display panel main body is deformed when subjected to an external force from the viewer's side, the external force may act on the front glass of the flat display panel main body, and the flat display panel main body may be broken, and its prevention is also important.

SUMMARY OF THE INVENTION

Accordingly, it is an object of the present invention is to provide a flat display panel comprising a flat display panel main body and a front protective plate having an electromagnetic wave shielding function and a near infrared ray shielding function unitedly bonded to the main body, which has a favorable and stable near infrared ray shielding effect and which can more securely prevent breakage of the flat display panel main body.

According to one aspect of the present invention, there is provided a flat display panel comprising a flat display panel main body, and a front protective plate which comprises an antireflection layer, a translucent electrically conductive layer containing a metal having an electromagnetic wave shielding property and a near infrared ray shielding property, a highly rigid transparent substrate made of a tempered glass or a semi-tempered glass and an adhesive layer laminated in this order, bonded to the viewer's side surface of the flat display panel main body by means of the adhesive layer.

In the flat display panel, the flat display panel main body may be PDP.

The electrically conductive layer in the present invention may have such a construction comprising an electrically conductive multilayer film comprising an oxide layer and a metal layer alternately laminated, and an earth electrode connected to the electrically conductive multilayer film.

The metal layer is preferably one composed of Ag or one containing Ag as the main component and containing at least one of Pd, Au and Cu, and the oxide layer in the electrically conductive multilayer film is preferably one containing ZnO as the main component and containing at least one oxide of a metal selected from the group consisting of Sn, Al, Cr, Ti, Si, B, Mg and Ga.

The present inventors have further conducted extensive studies on a change in the near infrared ray shielding effect when the near infrared ray shielding layer containing a near infrared ray absorbent is applied to a front protective plate of a type to be bonded and united with a PDP main body, and as a result, have found that the surface temperature of the PDP main body at the time of lighting increases to a level of 60° C. by the average temperature on the entire screen, and partially increases to so high as about 80° C. at a point of continuous lighting, and that as shown by a heat deterioration resistance test of Reference Example 1 as described hereinafter, when a near infrared ray shielding film containing a near infrared ray absorbent is exposed to a high temperature of 80° C., the optical properties significantly deteriorate.

The present inventors have further conducted extensive studies and as a result, have found that when a glass substrate is laminated on the surface of a PDP main body, the surface temperature decreases to a level of 40° C. on the surface of the glass substrate, even at a portion where the temperature reaches 80° C. on the surface of the PDP main body. They have further found that with respect to a near infrared ray shielding film containing a near infrared ray absorbent, no significant deterioration of the optical properties takes place when the heating temperature is so low as about 40° C., as shown by a heat deterioration resistance test of Reference Example 2 as described hereinafter. The present invention has been accomplished on the basis of these discoveries.

Namely, according to another aspect of the present invention, there is provided a flat display panel comprising a flat display panel main body and a front protective plate which comprises a transparent substrate, an electromagnetic wave shielding layer, a near infrared ray shielding layer containing a near infrared ray absorbent, provided on one side of the transparent substrate, and an adhesive layer provided as the outermost layer on the other side of the transparent substrate, bonded to the viewer's side surface of the flat display panel main body by means of the adhesive layer.

The flat display panel having such a construction is provided with a near infrared ray shielding layer and an electromagnetic wave shielding layer, whereby a near infrared ray shielding effect and an electromagnetic wave shielding effect can be obtained.

Particularly, a transparent substrate is interposed between a flat display panel main body and a near infrared ray shielding layer containing a near infrared ray absorbent, and this transparent substrate has a role as a heat buffering layer which reduces heat transmitted from the surface of the flat display panel main body to the near infrared ray shielding layer. Accordingly, even when the surface temperature of the flat display panel main body becomes high at the time of lighting, heat deterioration of the near infrared ray absorbent contained in the near infrared ray shielding layer can be prevented, whereby a favorable and stable near infrared ray shielding effect can be obtained.

Further, the near infrared ray shielding layer employing a near infrared ray absorbent is easily formed and its material is available at a low cost, whereby cost cutting can be attempted.

It is preferred to provide an antireflection layer as the outermost layer on one side of the transparent substrate of the front protective plate.

The flat display panel having such a construction is provided with an antireflection layer, whereby an antireflection effect can be obtained. Here, the antireflection layer may be provided so as to be the outermost layer of the front protective plate.

A layer other than the transparent substrate, highly rigid transparent substrate, electrically conductive layer, electromagnetic wave shielding layer, near infrared ray shielding layer, antireflection layer and adhesive layer of the present invention, such as a pollution preventing layer, may be provided on the outside of the front protective plate of the present invention, as the case requires.

Now, the present invention will be described in detail with reference to the preferred embodiments.

DETAILED DESCRIPTION OF THE INVENTION

First Embodiment

Figure 1:
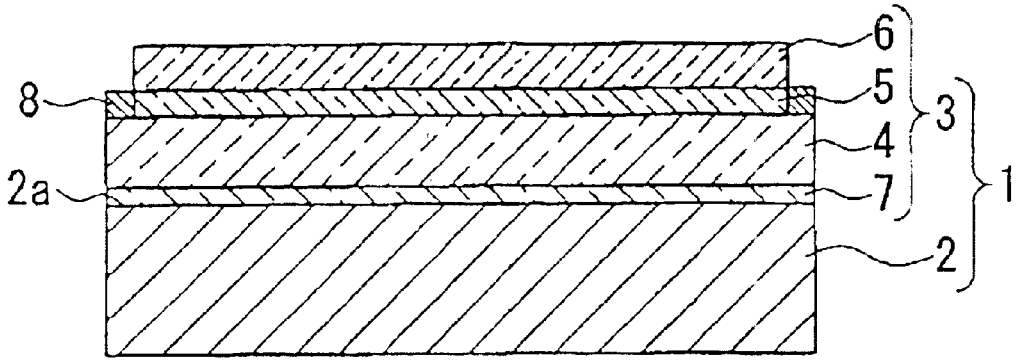
FIG. 1 is a sectional view illustrating a first embodiment of the flat display panel of the present invention.

FIG. 1 is a sectional view illustrating one embodiment of the flat display panel of the present invention. In the present embodiment, the flat display panel 1 comprises a flat display panel main body 2 and a highly rigid front protective plate 3 bonded to the viewer's side surface 2*a* (hereinafter referred to as surface 2*a*) of the flat display panel main body. This front protective plate 3 comprises a highly rigid transparent substrate 4, an electrically conductive layer 5, an antireflection layer 6 and an adhesive layer 7. Now, each of these constituents will be explained below.

Flat Display Panel Main Body

As the flat display panel main body 2 applicable in the present invention, various flat display panels such as PDP, plasma address liquid crystal display panels (PALC) and field emission displays (FED) may be mentioned. Among them, advantages in applying the present invention are remarkable for PDP for which shielding of electromagnetic waves and near infrared rays is required.

The following explanation exemplifies a case where PDP is employed as the flat display panel, the "flat display panel 1" is referred to as "PDP 1" and the "flat display panel main body 2" is referred to as "PDP main body 2".

As the PDP main body 2, PDP devices of various constructions may be used. In a typical PDP, partition walls to form a large number of discharge cells are sandwiched between two glass substrates, electrodes for discharge are formed in each of the discharge cells, a phosphor layer which emits red color, green color or blue color light is formed in each of the discharge cells, and a gas containing xenon (Xe) is sealed in each discharge cell. By making a phosphor in the discharge cell selectively emit light by discharge, a full color display is possible. At the starting time of the PDP main body 2, electromagnetic waves and near infrared rays are emitted from the surface 2*a*.

Front Protective Plate

The highly rigid front protective plate 3 comprises a highly rigid transparent substrate 4 made of glass, a translucent electrically conductive layer 5 containing a metal having an electromagnetic wave shielding property and a near infrared ray shielding property, provided on one side of the substrate 4, an antireflection layer 6 provided on the surface of the electrically conductive layer 5 opposite to the substrate 4, and an adhesive layer 7 provided on the other side of the substrate 4. This highly rigid front protective plate 3 is bonded to the surface 2*a* of the PDP main body 2 by means of the adhesive layer 7.

Highly Rigid Transparent Substrate

As the highly rigid transparent substrate 4 of the present invention, a tempered glass or a semi-tempered glass (heat strengthen glass) may be employed. Glass has a coefficient of thermal expansion half or less of that of a plastic material, it does not warp even if there is a slight difference in temperature between the surface on the PDP main body 2 side and the opposite side surface, and it is excellent also in heat resistance and chemical stability. The thickness of the highly rigid transparent substrate 4 can suitably be set depending upon the dimension of the PDP main body 2, and it is usually from 1 to 5 mm, preferably at a level of from 2 to 4 mm.

By unitedly bonding the front protective plate 3 having the highly rigid transparent substrate 4 made of a tempered glass or a semi-tempered glass to the surface 2*a* of the PDP main body 2, the surface 2*a* of the PDP main body 2 can be made to have high rigidity. The area of the screen of the PDP main body 2 can be made large as compared with a cathode ray tube, PDP having a screen exceeding 30 inch becomes used practically, and PDP having a larger screen tends to be used. For such a large PDP main body 2, it is required to increase the rigidity of the entire surface 2*a*. Namely, if the protective plate is disposed on the surface 2*a* of the PDP main body 2 with an air gap, if the protective plate is made of a synthetic resin having a low rigidity, it easily bend when an external force is applied to its center portion, the center portion contacts with the PDP main body 2 and as a result, the external force is directly applied to the PDP main body 2, thus leading to breakage of the PDP main body 2. Further, even when the protective plate is made of a glass plate to increase the rigidity, if there is a space between the protective plate and the surface 2*a* of the PDP main body 2, the external force is applied only to the protective plate, and the protective plate is broken when an external force exceeding the limit of strength of the protective plate is applied thereto. On the other hand, in the present embodiment, the front protective plate 3 having the highly rigid transparent substrate 4 made of a tempered glass or a semi-tempered glass is unitedly bonded to the surface 2*a* of the PDP main body 2, and the glass plate constituting the surface 2*a* of the PDP main body and the highly rigid transparent substrate 4 are bonded by means of the adhesive layer 7, whereby an external force can be supported by both the highly rigid transparent substrate 4 and the glass plate of the PDP main body 2, and accordingly PDP 1 of the present invention has a high rigidity. Further, as the glass plate constituting the surface 2*a* of the PDP main body and the highly rigid transparent substrate 4 are bonded by means of the adhesive layer 7, the reflection on the interface can significantly be reduced, and a double image due to reflection of an external object can be minimized, as compared with a case where the protective plate is disposed on the surface 2*a* side of the PDP main body 2 with an air gap.

Such a highly rigid transparent substrate 4 may be one prepared in accordance with a known glass tempering process, particularly, it may be prepared by an air-cooling tempering method of heating a glass plate at a predetermined temperature range, preferably from 650 to 700° C., followed by forcible air cooling for tempering. By properly adjusting the air cooling conditions (mainly cooling rate), or depending upon the thickness of glass, a tempered glass having an average breaking stress of at least 100 MPa or a semi-tempered glass having an average breaking stress of from 60 to 100 MPa can be obtained. Even if the tempered glass or semi-tempered glass prepared by air-cooling tempering is broken by any chance, its broken fragments tend to be small and they are hardly to be sharp-edged like a knife, such being favorable in view of safety.

Electrically Conductive Layer

The translucent electrically conductive layer 5 has at least one metal layer having an electromagnetic wave shielding property and a near infrared ray shielding property provided on one side of the highly rigid transparent substrate 4. The metal layer is preferably a layer composed of at least one metal selected from the group consisting of Au, Ag and Cu or a layer containing said metal as the main component, and particularly preferred is a metal layer containing Ag as the main component, whereby a low resistivity and small absorption can be achieved. Further, the metal layer containing Ag as the main component is preferably a metal layer containing Ag as the main component and containing at least one of Pd, Au and Cu, whereby diffusion of Ag is suppressed and as a result, moisture resistance improves. The content of at least one of Pd, Au and Cu is preferably from 0.3 to 10 atomic % based on the total content of Ag and at least one metal of Pd, Au and Cu. If it is at least 0.3 atomic %, an effect of stabilizing Ag can be obtained, and when it is at most 10 atomic %, favorable layer formation rate and visible light transmittance can be obtained while maintaining favorable moisture resistance. Accordingly, from the above viewpoint, the addition amount is suitably at most 5.0 atomic %. Further, if the addition amount is increased, the target cost remarkably increases, and accordingly it is within a range at a level of from 0.5 to 2.0 atomic %, by taking usually required moisture resistance into consideration. In a case where the electrically conductive layer 5 is formed as a single layer, the thickness of the metal layer is considered to be from 5 to 20 nm, preferably from 8 to 15 nm. The method of forming the metal layer is not particularly limited, but preferably the layer is formed by sputtering capable of uniformly forming a thin metal layer directly on one side of the transparent substrate. Otherwise, a metal layer may be formed on a film-like transparent substrate by sputtering, and the obtained sputtered film may be bonded to one side of the transparent substrate 4.

In the present invention, as the electrically conductive layer 5, an electrically conductive multilayer film comprising an oxide layer and a metal layer alternately laminated on the highly rigid transparent substrate 4, particularly an electrically conductive multilayer film comprising an oxide layer, a metal layer and an oxide layer alternately laminated in this order in (2n+1) layers (wherein n is an integer of at least 1) on the highly rigid transparent substrate 4, is suitably used. The oxide layer may be a layer containing as the main component at least one oxide of a metal selected from the group consisting of Bi, Zr, Al, Ti, Sn, In and Zn. It is preferably a layer containing as the main component at least one oxide of a metal selected from the group consisting of Ti, Sn, In and Zn. Particularly preferred is a layer containing ZnO as the main component, whereby the absorption is small and the refractive index is approximately 2, or a layer containing $TiO_2$ as the main component, whereby the refractive index is high, and a preferred color tone can be obtained with a small number of layers. The oxide layer may be constituted by a plurality of tin oxide layers. For example, it may be formed by a layer containing $SnO_2$ as the main component and a layer containing ZnO as the main component, instead of an oxide layer containing ZnO as the main component.

The oxide layer containing ZnO as the main component is preferably an oxide layer made of ZnO containing at least one metal other than Zn. Said at least one metal contained is present mainly in a state of an oxide in the oxide layer. The ZnO containing at least one metal is preferably ZnO containing at least one metal selected from the group consisting of Sn, Al, Cr, Ti, Si, B, Mg and Ga. The content of said at least one metal is preferably from 1 to 10 atomic % based on the total amount of said metal and Zn, whereby moisture resistance of the electrically conductive film to be obtained improves. When it is at least 1 atomic %, the internal stress of the ZnO film can adequately be reduced, and favorable moisture resistance can be obtained. Further, when it is at most 10 atomic %, crystallinity of ZnO can favorably be maintained, and compatibility with the metal layer does not decrease. The content of the metal is preferably from 2 to 6 atomic %, so as to obtain a ZnO film having a low internal stress stably with good reproducibility, and by taking crystallinity of ZnO into consideration.

The geometrical film thickness (hereinafter referred to simply as thickness) of the oxide layer is preferably from 20 to 60 nm (particularly from 30 to 50 nm) with respect to an oxide layer which is the closest to the transparent substrate and an oxide layer which is the furthest from the transparent substrate, and from 40 to 120 nm (particularly from 40 to 100 nm) with respect to the other oxide layers. The total thickness of the metal layers is preferably from 25 to 40 nm (particularly from 25 to 35 nm) in a case where the aimed resistance of the electrically conductive layer to be obtained is 2.5 Ω/□, and from 35 to 50 nm (particularly from 35 to 45 nm) in a case where the aimed resistance is 1.5 Ω/□. The total thickness of the oxide layers and metal layers is preferably from 150 to 220 nm (particularly from 160 to 200 nm) in a case where the number of metal layers is 2, from 230 to 330 nm (particularly from 250 to 300 nm) in a case where the number of metal layers is 3, and from 270 to 370 nm (particularly from 310 to 350 nm) in a case where the number of metal layers is 4, for example.

Between the first metal layer and the second oxide layer, between the second metal layer and the third oxide layer, and between the third metal layer and the fourth oxide layer, another layer to prevent the metal layer from being oxidized at the time of forming the oxide layer (hereinafter referred to as an oxidation barrier layer) may be provided. The oxide barrier layer may, for example, be a metal layer, an oxide layer or a nitride layer. Specifically, at least one metal selected from the group consisting of Al, Ti, Si, Ga and Zn, an oxide or a nitride of said metal may, for example, be mentioned. Preferably ZnO containing Ti or Si and Ga is employed. The thickness of the oxide barrier layer is preferably from 1 to 7 nm. If it is thinner than 1 nm, the layer exhibits no sufficient function as a barrier layer. If it is thicker than 7 nm, the transmittance of the film system decreases.

Further, on the surface of the electrically conductive layer 5, a protective layer made of an oxide film or a nitride film is preferably provided. The protective layer is employed to protect the electrically conductive layer 5 (particularly metal layer containing Ag) from moisture, and to protect the oxide layer (particularly layer containing ZnO as the main component) of the electrically conductive layer 5 from an adhesive (particularly an alkaline adhesive) at the time of bonding the antireflection layer 6. Specifically, a layer of an oxide or a nitride of a metal such as Zr, Ti, Si, B or Sn may, for example, be mentioned. Particularly when a layer containing ZnO as the main component is used as the outermost layer of the electrically conductive layer 5, a nitride film is preferably used. The nitride film may be a nitride film of Zr and/or Si, and particularly a composite nitride film of Zr and Si is preferably used. The protective layer is formed preferably in a thickness of from 5 to 30 nm, particularly from 5 to 20 nm.

To the electrically conductive layer 5, an electrode 8 for ground lead connection, to introduce an electric current generated in the layer resulting from electromagnetic waves emitted from the PDP main body 2 to a ground lead, is connected. This electrode 8 is formed on one side of the highly rigid transparent substrate 4 so that the electrode is in contact with at least part of the periphery of the electrically conductive layer 5. Its shape and dimension are not particularly limited, but one having a low resistance is superior in electromagnetic wave shielding property. This electrode 8 is preferably provided on the entire periphery of the highly rigid transparent substrate 4, so as to secure the electromagnetic wave shielding effect of the translucent electrically conductive film 5. As such an electrode 8, an electrode obtained by coating a Ag paste (a paste containing Ag and glass frit) or a Cu paste (a paste containing Cu and glass frit), followed by firing, is suitably employed. As this firing step can be carried out simultaneously with the tempering step of the above-described highly rigid transparent substrate 4, and accordingly it is preferred to coat the glass transparent substrate before tempering step with the Ag or Cu paste. Further, such a construction that the electrically conductive layer 5 has a longitudinal ground lead not shown in FIG. 1 connected to the electrode 8 may also be mentioned.

Antireflection Layer

The antireflection layer 6 may be any layer having an antireflection property, and any known antireflection method may be employed. For example, it may be a layer subjected to an antiglare treatment or a layer having a low refractive index layer. The low refractive index layer may be formed from a known low refractive index material, but is preferably formed from a non-crystalline fluoropolymer in view of an antireflection effect and easiness in layer formation. Preferred is one comprising a resin film and a low refractive index layer formed on one side of the resin film, from the viewpoint of prevention of scattering of fragments when the highly rigid transparent substrate 4 itself is broken by any chance. Particularly preferred is an antireflection layer comprising a polyurethane type flexible resin layer and a low refractive index layer made of a non-crystalline fluoropolymer formed on one side of the resin layer, and specifically, ARCTOP (tradename) manufactured by Asahi Glass Company, Limited may, for example, be mentioned.

A resin film which shields near infrared rays (such as a resin film having a near infrared ray absorbent incorporated therein) may be provided on the electrically conductive film side (viewer's side) of the front of the transparent substrate and/or the rear side (PDP main body side) of the transparent substrate. Otherwise, in a case where the above-described scattering preventing and antireflection resin film such as ARCTOP (tradename) is used as the antireflection layer, a near infrared ray absorbent may be incorporated in the polyurethane resin layer so that the scattering preventing and antireflection film has a near infrared ray shielding effect. In PDP 1 of the present invention, near infrared rays can be shielded by the electrically conductive layer 5, but by making the antireflection layer 6 have a near infrared ray shielding property, the near infrared ray shielding effect can further be improved. Further, by incorporating a pigment and/or a dye which absorb visible light having a specific wavelength, a color tone correcting property which corrects the color balance of the display color can be imparted.

Adhesive Layer

The front protective plate 3 is bonded to the surface 2*a* of the PDP main body 2 by means of the adhesive layer 7. An adhesive suitable for the adhesive layer 7 in the present invention may, for example, be a hot melt type adhesive such as an ethylene/vinyl acetate copolymer (EVA), an epoxy or acrylate type ultraviolet curing adhesive or a silicone or urethane type thermosetting adhesive. The adhesive layer 7 may composed of at least two layers. In a case of three layers or more, a layer which is not in direct contact with the front protective plate or the PDP main body may not have an adhesive property. The thickness of the adhesive layer 7 is from 0.1 to 1.0 mm, preferably from 0.2 to 0.5 mm.

When a hot melt sheet comprising a hot melt type adhesive is used as the adhesive layer 7, as a suitable method of bonding the front protective plate 3 and the PDP main body 2 by means of the adhesive layer 7, the following method may be mentioned. Namely, a hot melt sheet is put on the surface 2*a* of the PDP main body 2, the front protective plate 3 is put thereon and positioning is carried out, and they are temporarily fixed with a heat resistant adhesive tape. Then, the temporarily fixed assembly is put and sealed in a heat resistant resin bag equipped with an exhaust hall. Then, the exhaust hall is connected to a vacuum pump to deaerate the air in the bag, and the bag is put in a heating oven and heated at a melt-adhesion temperature of the hot melt. After completion of the heating, the bag is taken out from the oven and the pressure reduction is terminated, and PDP 1 comprising the PDP main body 2 and the front protective plate 3 bonded to the surface 2*a* of the PDP main body 2 by means of the adhesive layer 7 is taken out.

PDP 1 according to the present embodiment has such a construction that the front protective plate 3 having the highly rigid transparent substrate 4 made of a tempered glass or a semi-tempered glass is unitedly bonded to the surface 2*a* of the PDP main body 2, and the glass plate constituting the surface 2*a* of the PDP main body and the highly rigid transparent substrate 4 are bonded by means of the adhesive layer 7, whereby an external force applied from the viewer's side can be supported by both the highly rigid transparent substrate 4 and the glass plate of the PDP main body 2, and an extremely high rigidity is imparted to the viewer's side of the PDP 1, and accordingly PDP 1 which is less likely to be broken can be provided. Further, by bonding the glass plate constituting the surface 2*a* of the PDP main body and the highly rigid transparent substrate 4 by means of the adhesive layer 7, the reflection on the interface can significantly be reduced, and a double image due to reflection of an external object can be minimized, as compared with a case where the protective plate is disposed on the surface 2*a* side of the PDP main body 2 with an air gap.

Second Embodiment

Figure 2:
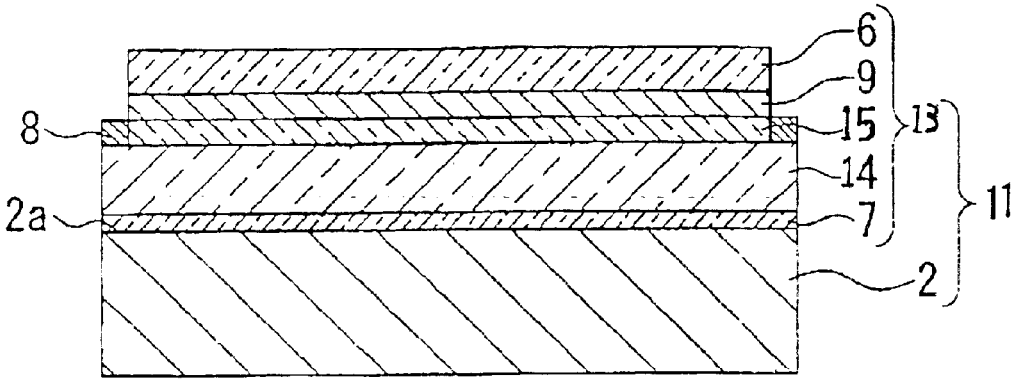
FIG. 2 is a sectional view illustrating a second embodiment of the flat display panel of the present invention.

FIG. 2 is a diagram illustrating the second embodiment of the flat display panel of the present invention. In the present embodiment, the flat display panel 11 comprises a flat display panel main body 2 and a front protective plate 13 bonded to the viewer's side surface 2*a* (hereinafter referred to as surface 2*a*) of the main body.

The front protective plate 13 comprises a transparent substrate 14, an electromagnetic wave shielding layer 15, a near infrared ray shielding layer 9, an antireflection layer 6 and an adhesive layer 7.

Front Protective Plate

In the present embodiment, the front protective plate 13 has such a construction that on one side of the transparent substrate 14, the electromagnetic wave shielding layer 15, the near infrared ray shielding layer 9 and the antireflection layer 6 are laminated in this order, and the adhesive layer 7 is formed on the other side of the transparent substrate 14. The front protective plate 13 is bonded to the surface 2*a* of the PDP main body 2 by means of the adhesive layer 7.

Transparent Substrate

As the transparent substrate 14, various glass substrates and various transparent resin substrate may be used. Particularly in the present embodiment, the transparent substrate 14 functions also as a heat buffering layer, and it is thereby preferably one having a low coefficient of thermal conductivity and a high heat buffering effect. Specifically, preferred is one having a heat buffering effect at such a level that when it is bonded to the heated surface at 80° C., the surface temperature is kept to at most 40° C. on the side opposite to the bonded surface. Specific examples thereof include various glass substrates and organic polymer materials.

Further, the transparent substrate 14 is preferably a highly rigid transparent substrate having an elastic modulus in bending of at least 2,000 MPa at 23° C., and substrates made of various glasses, polycarbonates and acryl resins may, for example, be mentioned. Among them, preferred is glass having a high elastic modulus, and among various glasses, preferred is a tempered glass having an average breaking stress of at least 100 MPa or a semi-tempered glass (heat strengthen glass) having an average breaking stress of from 60 to 100 MPa.

When the transparent substrate 14 has an elastic modulus in bending of at least 2,000 MPa, the front protective plate 13 itself is hardly deformed when an external force is applied thereto, and the external force is less likely to affect the glass constituting the surface 2*a* of the PDP main body 2. Accordingly, mechanical strength of the PDP main body 2 to which the front protective plate 13 is unitedly bonded is effectively improved and its breakage can be prevented. Particularly glass has a coefficient of thermal expansion half or less of that of a plastic material, it does not warp even if there is a slight difference in temperature between the surface on the PDP main body 2 side and the opposite side surface , and it is excellent also in heat resistance and chemical stability, and accordingly it is suitable as the transparent substrate 14.

When the highly rigid transparent substrate is used as the transparent substrate 14, the thickness is set so that sufficient mechanical strength can be imparted to the PDP main body 2, and a sufficient heat buffering effect can be obtained as well, but it is usually at a level of from 1 to 5 mm.

The tempered glass or semi-tempered glass suitable as the transparent substrate 14, is prepared in the same manner as the above-described method.

The electromagnetic wave shielding layer 15 is made of an electrically conductive film comprising at least one metal layer or a mesh electrically conductive film formed in the form of a mesh.

As the electrically conductive film comprising at least one metal layer, the above-described translucent electrically conductive film 5 may be used.

As the mesh electrically conductive film, one formed by photolithography, one formed by printing, or a fiber mesh may, for example, be used. Among them, an electrically conductive mesh film formed by photolithography has a surface resistance of so small as about 0.05 Ω/□ and is thereby used particularly preferably.

Specifically, an electrically conductive mesh film formed by photolithography film comprises a metal mesh and a resin film, and as a method of producing it, a method may be mentioned wherein one having a metal thin film such as a copper film bonded to a resin film or one having a metal thin film formed on a resin film by vapor deposition or plating, is subjected to patterning by photolithography, and the metal thin film is subjected to etching in the form of a mesh.

The material of the metal thin film to be used for formation of the electrically conductive mesh film formed by photolithography film may, for example, be copper, aluminum, stainless steel, nickel, titanium, tin, tungsten or chromium, or an alloy thereof. Among them, preferred is copper, aluminum or stainless steel. The thickness of the metal thin film is from 2 to 20 $\mu$m, preferably from 3 to 10 $\mu$m, in view of electromagnetic wave shielding property and etching property.

The resin film to be used for formation of the electrically conductive mesh film formed by photolithography film may, for example, be PET (polyethylene terephthalate), PMMA (polymethyl methacrylate), PC (polycarbonate), TAC (triacetyl cellulose) or polystyrene.

The mode of the mesh of the electrically conductive mesh film formed by photolithography film is preferably such that the pitch is from 200 to 400 $\mu$m and the line width is at a level of from 5 to 30 $\mu$m.

To the electromagnetic wave shielding layer 15, an electrode 8 for ground lead connection similar to one in the case of the above-described electrically conductive layer 5 is connected.

Antireflection Layer

The antireflection layer 6 may be any layer having an antireflection property, and any known antireflection method may be employed. For example, it may be a layer subjected to an antiglare treatment or a layer having a low refractive index layer. The low refractive index layer may be formed from a known low refractive index material, but is preferably made of a non-crystalline fluoropolymer in view of an antireflection effect and easiness in layer formation. Preferred is one comprising a resin film and a low refractive index layer formed on one side of the resin film, from the viewpoint of prevention of scattering of fragments when the highly rigid transparent substrate 4 itself is broken by any chance. Particularly preferred is an antireflection layer comprising a polyurethane type flexible resin layer and a low reflective index layer made of a non-crystalline fluoropolymer formed on one side of the resin layer, and specifically, ARCTOP (tradename) manufactured by Asahi Glass Company, Limited may, for example, be mentioned.

Near Infrared Ray Shielding Layer

The near infrared ray shielding layer 9 is made of a resin composition comprising a resin as the main component and a near infrared ray absorbent dispersed in the resin.

The method for forming the near infrared ray shielding layer 9 is not particularly limited, but it is preferably formed by coating a substrate with a solution obtained by uniformly mixing the main component, the near infrared ray absorbent and a solvent. As the coating method, dip coating, roll coating, spray coating, gravure coating, comma coating, die coating, etc., may be selected. By these coating methods, continuous processing is possible, and thus the productivity is excellent as compared with a batch system vapor deposition method. Spin coating capable of forming a thin and uniform coating film may also be employed.

As the substrate to be used in the coating method, a transparent resin film is preferred, and a resin film of polyester type, acryl type, cellulose type, polyethylene type, polypropylene type, polyolefin type, polyvinyl chloride type, polycarbonate type, phenol type or urethane type may, for example, be employed. Among them, a polyester film such as a polyethylene terephthalate film is suitable.

In a case where a near infrared ray shielding film comprising a transparent film and a coating film (near infrared ray shielding layer 9) made of a resin composition having a near infrared ray absorbent dispersed therein formed on the transparent film, is used to constitute the near infrared ray shielding layer 9, the transparent resin film used as the substrate is interposed between the near infrared ray shielding layer 9 and the electromagnetic wave shielding layer 15, although not shown in FIG. 2.

Further, in a case where a laminate comprising a resin film and a low refractive index layer formed on one side of the resin film, such as the above-described ARCTOP (tradename), is used as the antireflection layer 6, it is possible to use the resin film of the antireflection layer 6 as the substrate and to coat the other side of the antireflection layer with a solution made by uniformly mixing the main component, a near infrared ray absorbent and a solvent to form the near infrared ray shielding layer 9.

In such a case, no substrate is present between the near infrared ray shielding layer 9 and the electromagnetic wave shielding layer 15, and to the electromagnetic wave shielding layer 15, a laminate comprising the near infrared ray shielding layer 9 and the antireflection layer 6 integrated with each other is bonded.

Otherwise, a near infrared ray absorbent may be incorporated in the low refractive index layer constituting the antireflection layer 6 to obtain a near infrared ray shielding layer having an antireflection function. In such a case, it is not necessary to separately form the antireflection layer 6 and the near infrared ray shielding layer 9, and on the electromagnetic wave shielding layer 15, a near infrared ray shielding layer having an antireflection function is provided, although not shown in FIG. 2.

Otherwise, in a case where a laminate comprising a resin film and a low refractive index layer formed on one side of the resin film, such as the above-described ARCTOP (tradename), is employed as the antireflection layer 6, it is also possible to incorporate a near infrared ray absorbent into the resin film so as to use the laminate as a near infrared ray shielding layer having an antireflection function. In such a case also, it is not necessary to separately provide the antireflection layer 6 and the near infrared ray shielding layer 9, and the near infrared ray shielding layer having an antireflection function is provided on the electromagnetic wave shielding layer 5, although not shown in FIG. 2.

The main component is not particularly limited so long as a near infrared ray absorbent can uniformly be disposed therein, and a thermoplastic resin such as a polyester type resin, an olefin type resin, a cycloolefin type resin or a polycarbonate resin may, for example, be suitably used. Specifically as the main component, a commercially available product such as a polyester resin "O-PET", tradename, manufactured by Kanebo Ltd; a polyolefin resin "ARTON", tradename, manufactured by JSR Corporation, a cycloolefin resin "ZEONEX", tradename, manufactured by ZEON Corporation or "Iupilon", tradename, manufactured by Mitsubishi Engineering-Plastics Corporation, may be used.

The solvent in which the main component is dissolved is not particularly limited, and it may, for example, be a ketone type solvent such as cyclohexanone, an ether type solvent, an ester type solvent such as butyl acetate, an ether alcohol type solvent such as ethyl cellosolve, a ketone alcohol type solvent such as diacetone alcohol or an aromatic type solvent such as toluene. They may be used alone or as a mixed solvent system comprising at least two types mixed.

As the near infrared ray absorbent, a colorant capable of absorbing at least part of light in the near infrared region (wavelength: 780 to 1,300 nm) is used, and the colorant may be either dye or pigment. Specifically, it may, for example, be a polymethine type, phthalocyanine type, naphthalocyanine type, metal complex type, aminium type, immonium type, diimmonium type, anthraquinone type, dithiol metal complex type, naphthoquinone type, indolphenol type, azo type or triallylmethane type compound, but is not limited thereto.

For the purpose of absorbing heat radiation and preventing noises of an electronic equipment, preferred is a near infrared ray absorbent having a maximum absorption wavelength of from 750 to 1,100 nm, and particularly preferred is a metal complex type, aminium type, phthalocyanine type, naphthalocyanine type or diimmonium type compound. The near infrared ray absorbent may be used alone or as a mixture of at least two types thereof.

The amount of the near infrared ray absorbent contained in the near infrared ray shielding layer 9 is preferably at least 0.1 mass % based on the main component in order to efficiently obtain a near infrared ray shielding effect, particularly preferably at least 2 mass %. Further, the amount of the near infrared ray absorbent is suppressed to preferably at most 10 mass % in order to maintain physical properties of the main component.

The thickness of the near infrared ray shielding layer 9 is preferably at least 0.5 $\mu$m in order to efficiently obtain the near infrared ray shielding effect, and it is preferably at most 20 $\mu$m from such a viewpoint that the solvent at the time of film formation is less likely to remain, and operation in the film formation tends to be easy. It is particularly preferably from 1 to 10 $\mu$m.

Adhesive Layer

As a suitable adhesive for the adhesive layer 7 in the present embodiment, the same adhesive as mentioned above may be mentioned. The thickness of the adhesive layer 7 is from 0.1 to 1.0 mm, preferably from 0.2 to 0.5 mm.

Production Process

To produce PDP 11 of the present embodiment, for example, on one side of the transparent substrate 14, the electrode 8 and the electromagnetic wave shielding layer 15 are formed in this order, and the near infrared ray shielding layer 9 is formed thereon by coating or by bonding, and the antireflection layer 6 is further bonded thereto. Then, the other side of the transparent substrate 14 is bonded to the PDP main body 2 by means of the adhesive layer 7. A preliminarily integrated near infrared ray shielding layer 9 and antireflection layer 6 may be used and bonded to the electromagnetic wave shielding layer 15.

In a case where the electrode 8 is formed by a Ag paste or a Cu paste, coating of the transparent substrate 14 may be suitably carried out by screen printing. Further, when a glass substrate is used as the transparent substrate 14, the glass substrate is also heated at the time of firing the electrode 8, whereby the glass substrate used as the transparent substrate 14 can be tempered by conducting an air-cooling step after the firing.

In a case where the electromagnetic wave shielding layer 15 is constituted by an electrically conductive film comprising at least one metal layer, it is formed preferably by sputtering, or a sputtered film prepared separately may be bonded to the surface of the transparent substrate 14 on which the electrode 8 is formed. Whereas, in a case where the electromagnetic wave shielding layer 15 is constituted by a mesh electrically conductive film, a mesh film on which the electrode 8 is formed, prepared separately, is bonded.

The layers may be bonded by means of a bonding method suitable for bonding films, such as a roll laminating machine, and an adhesive may be present between the layers as the case requires.

In a case where a hot melt sheet comprising a hot melt type adhesive is used as the adhesive, the same method as disclosed in the above first embodiment is suitably employed.

PDP 11 according to the present embodiment comprises the antireflection layer 6, the near infrared ray shielding layer 9 and the electromagnetic wave shielding layer 15, whereby an antireflection effect, a near infrared ray shielding effect and an electromagnetic wave shielding effect can be obtained.

There is possibility that the near infrared ray absorbent contained in the near infrared ray shielding layer 9 deteriorates by heat, however, the transparent substrate 14 is interposed between the PDP main body 2, the surface temperature of which increases at the time of lighting, and the near infrared ray shielding layer 9, and the transparent substrate 14 functions as a heat buffering layer and inhibits transmission of heat from the surface 2*a* of the PDP main body 2 to the near infrared ray shielding layer 9. Accordingly, heat deterioration of the near infrared ray absorbent contained in the near infrared ray shielding layer 9 is prevented, and favorable and stable near infrared ray shielding effect can be obtained.

Further, on the surface 2*a* of the PDP main body 2, the transparent substrate 14 is bonded and integrated by means of the adhesive layer 7, whereby the reflection on the interface can significantly be reduced, and a double image due to reflection of an external object can be minimized, as compared with a case where a space is present between the surface 2*a* side of the PDP main body 2 and a filter for protection provided in front of the PDP main body.

Further, in the present embodiment, as the electromagnetic wave shielding layer 15 is provided on the transparent substrate 14, the electromagnetic wave shielding layer 15 can be formed by sputtering, whereby formation of the electrode 8 to be connected to the electromagnetic wave shielding layer 15 is easy.

Further, in the present embodiment, in a case where the electromagnetic wave shielding layer 15 is constituted by an electrically conductive film comprising at least one metal layer, a near infrared ray shielding effect can be obtained also by the electromagnetic wave shielding layer 15, and the near infrared ray shielding layer 9 is provided in addition thereto, and accordingly the near infrared ray shielding effect further improves.

Third Embodiment

Figure 3:
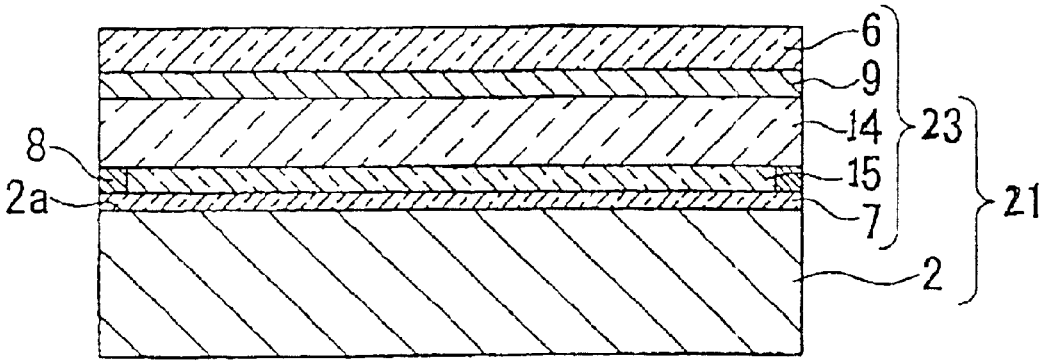
FIG. 3 is a sectional view illustrating a third embodiment of the flat display panel of the present invention.

FIG. 3 is a diagram illustrating the third embodiment of the flat display panel of the present invention. The difference between PDP 21 according to the present embodiment and PDP 11 according to the second embodiment is that in the present embodiment, an electromagnetic wave shielding layer 15 is provided on the PDP main body 2 side of a transparent substrate 14.

Namely, a front protective plate 23 according to the present embodiment has such a construction that on one side of a transparent substrate 14, a near infrared ray shielding layer 9 and an antireflection layer 6 are laminated in this order, and on the other side of the transparent substrate 14, an electromagnetic wave shielding layer 15 and an adhesive layer 7 are laminated in this order. This front protective plate 23 is bonded to the surface 2*a* of a PDP main body 2 by means of an adhesive layer 7.

In FIG. 3, for the same constituents as in FIG. 2, the same symbols are used and the explanation is omitted.

To produce PDP 21 according to the present embodiment, for example, on one side of the transparent substrate 14, the near infrared ray shielding layer 9 is formed by coating or by bonding, and the antireflection layer 6 is further bonded thereto. The near infrared ray shielding layer 9 and the antireflection layer 6 may preliminarily be integrated. Further, separately, on the other side of the transparent substrate 14, an electrode 8 and the electromagnetic wave shielding layer 15 are formed in this order. Formation of the electrode 8 and the electromagnetic wave shielding layer 15 and bonding of the layers can be carried out in the same manner as in the second embodiment. Then, the side where electromagnetic wave shielding layer 15 is formed is bonded to the PDP main body 2 by means of the adhesive layer 7. As the method of bonding the front protective plate 23 to the PDP main body 2 by means of the adhesive layer 7, the same method as in the second embodiment may be employed.

According to the present embodiment, the same effect as in the second embodiment can be obtained.

Now, the present invention will be described in further detail with reference to Examples. However, it should be understood that the present invention is by no means restricted to such specific Examples.

EXAMPLE 1

A PDP apparatus of the present invention was prepared in accordance with the following procedure.

Preparation of Front Protective Plate

A soda lime glass plate (thickness: 3.2 mm) was cut out in the same size as a PDP main body, followed by chamfering. Then, a Ag paste (manufactured by Murata Manufacturing Co., Ltd.) was printed by screen printing on the entire periphery with a width of 10 mm from the edge on one side of the rectangular glass plate. The glass plate printed with the Ag paste was heated at 660° C. and then tempered by forcible air cooling. To prevent formation of a sputtered film on the Ag paste, a portion printed with the Ag paste was covered with a stainless steel thin plate, and the thin plate was temporarily fixed with an adhesive tape. Then, on the glass surface printed with the Ag paste, a multilayer film comprising 3Al—ZnO (40 nm)/1.0Pd—Ag (10 nm)/3Al—ZnO (80 nm)/1.0Pd—Ag (12 nm)/3Al—ZnO (80 nm)/1.0Pd—Ag (10 nm)/3Al—ZnO (40 nm) was formed by sputtering. Film forming conditions for each film are shown in Table 1.

TABLE 1

| Film | Target | Introduction gas | Pressure (mTorr) | Power charged(W/cm$^2$) |
|---|---|---|---|---|
| 3Al—ZnO | 3Al—Zn | Oxygen | 2 | 3.6 |
| 1.0Pd—Ag | 1.0Pd—Ag | Argon | 2 | 0.8 |

"3Al—Zn" is meant for Zn containing 3 atomic % of Al based on the total amount of Al and Zn, and "3Al—ZnO" is meant for a film formed by sputtering using 3Al—Zn as a target in the presence of oxygen. Further, "1.0Pd—Ag" is meant for Ag containing 1.0 atomic % of Pd based on the total amount of Pd and Ag.

After formation of the multilayer film by sputtering, the stainless steel thin plate was separated.

Then, an antireflection film ("ARCTOP URP2179", tradename, manufactured by Asahi Glass Company, Limited) was bonded to the surface on which the film was formed by sputtering, by means of a roll laminating machine. Then, ARCTOP on the Ag paste was cut with a laser cutter and separated to prepare a front protective plate.

Integration of PDP Main Body and Front Protective Plate

The front protective plate as prepared above and a PDP main body were bonded and integrated by means of an adhesive layer by the following method. An EVA type hot melt sheet ("EVASAFE 1450", tradename, manufactured by Bridgestone Corporation) was cut in a size smaller than the PDP main body by about 5 mm vertically and horizontally. This sheet was disposed between the PDP main body and the side of the front protective plate where no antireflection layer was bonded, these three were overlaid one on another and temporarily fixed with a heat resistant adhesive tape at eight positions on the periphery. This temporarily fixed integrated product was put and sealed in a PET bag equipped with an exhaust hole. The pressure in the bag was reduced to 40 Torr by a vacuum pump, the temperature was raised to 80° C. over a period of 1 hour in a heating oven, and the bag was held at 80° C. for 20 minutes. While keeping the degree of pressure reduction, the temperature was raised to 110° C. over a period of 40 minutes, and the bag was held at 110° C. for 20 minutes. Then, when the bag was cooled to 80° C., the pressure reduction was terminated, and after the bag was cooled to room temperature, an integrated product (PDP) was taken out from the PET bag.

The front protective plate/PDP main body integrated product (PDP) thus prepared as a sample was subjected to the following breaking test by means of a Tensilon testing machine. The stress was 8.3 MPa and the distortion was 3 mm when PDP of the present Example was broken.

Breaking Test Method

A compression type load cell was used, a steel ball (diameter: 30 mm) was employed for the load edge, and a rubber sheet was interposed between the steel ball and the sample.

The above integrated product sample was fixed to the Tensilon testing machine by means of a wood support frame sandwiching the periphery of the sample. The steel ball to apply a load was set to approximately center portion of the sample, and measurement was carried out at a crosshead speed of 0.5 mm/min. The time when the panel was broken was judged from e.g. appearance and the change in load, and the distortion and strength at that time was calculated from the results of the measurement chart.

EXAMPLE 2

PDP was prepared in the same manner as in Example 1 except that the thickness of the soda lime glass was 2.5 mm, and the breaking test was carried out. The stress was 6.5 MPa and the distortion was 3 mm when the PDP was broken.

COMPARATIVE EXAMPLE 1

PDP was prepared in the same manner as in Example 1 except that no tempering by heating and forcible air cooling was carried out, and the breaking test was carried out. The stress was 4.2 MPa and the distortion was 2.8 mm when the PDP was broken.

COMPARATIVE EXAMPLE 2

The same breaking test as in Example 1 was carried out with regard to the PDP main body alone, and the stress was 2.2 MPa and the distortion was 2.6 mm when the PDP main body was broken.

EXAMPLE 3

A front protective plate having a film by sputtering formed thereon and an antireflection film bonded thereto was obtained in the same manner as in Example 1 except that the thickness of the soda lime glass plate was 2.5 mm.

This front protective plate and a PDP main body were bonded and integrated by mans of an adhesive layer by the following method.

100 Parts by mass of a silicone resin solution ("SE1885A", tradename, manufactured by Dow Corning Toray Silicone Co., Ltd.) and 100 parts by mass of a curing agent for silicone resin ("SE1885B", tradename, manufactured by Dow Corning Toray Silicone Co., Ltd.) were mixed, and the side of the front protective plate where the antireflection film was not bonded, was coated with the above mixture in a thickness of 0.5 mm by means of a bar coater, followed by annealing treatment at 100° C. for 30 minutes to prepare a front protective plate having an adhesive layer comprising a silicone resin formed thereon.

This front protective plate was overlaid on the PDP main body so that the side of the adhesive layer comprising the silicone resin was in contact with the PDP main body, followed by pressing by means of rubber rolls for lamination to obtain an integrated product of the front protective plate and the PDP main body. The breaking test was carried out in the same manner as in Example 1, and the stress was 9.8 MPa and the distortion was 2.6 mm when the PDP was broken.

EXAMPLE 4

An integrated product of a front protective plate and a PDP main body was obtained in the same manner as in Example 3 except that the following polyurethane film adhesive layer was employed instead of the adhesive layer comprising the silicone resin. The breaking test was carried out in the same manner as in Example 1, and the stress was 9.0 MPa and the distortion was 2.6 mm when the PDP was broken.

65 Parts by mass of Preminol PML-3012 (tradename, polyether type polyol manufactured by Asahi Glass Company, Limited), 28 parts by mass of Excenol EL-1030 (tradename, polyether type polyol manufactured by Asahi Glass Company, Limited), 100 parts by mass of Preminol PML-1003 (tradename, polyether type polyol manufactured by Asahi Glass Company, Limited), 30 parts by mass of hexamethylene diisocyanate, 0.2 part by mass of dibutyltin dilaurate and 2 parts by mass of an antioxidant ("IRGANOX 1010", tradename, manufactured by Ciba-Geigy) were mixed, followed by deaeration, and cast on a polyethylene terephthalate film having a thickness of 100 $\mu$m subjected to a release treatment and reacted at 80° C. for 20 minutes, and then separated from the polyethylene terephthalate film to obtain a polyurethane film having a thickness of 0.5 mm.

Each side of the polyurethane film was coated with an acryl type adhesive (a mixture comprising 150 parts by mass of SK-DYNE 1604N, tradename, manufactured by Soken Chemical & Engineering Co., Ltd. and 2 parts by mass of L-45, tradename, manufactured by Soken Chemical & Engineering Co., Ltd.) by means of a bar coater, followed by drying and annealing treatment at 100° C. for 10 minutes to obtain a polyurethane film adhesive layer having an acryl type adhesive in a thickness of 0.015 mm laminated on each side thereof.

EXAMPLE 5

A PDP apparatus of the present invention was prepared in accordance with the following procedure.

Preparation of Front Protective Plate

A glass substrate having a film by sputtering formed thereon was obtained in the same manner as in Example 1 except that the thickness of the soda lime glass plate was 2.5 mm.

Then, a near infrared ray shielding film was bonded to the side where the film by sputtering was formed, by means of a roll laminating machine. As the near infrared ray shielding film, one produced as follows was employed.

First, a polyester resin for optical use ("O-PET", tradename, manufactured by Kanebo, Ltd.) was dissolved in cyclopentanone so that the resin concentration would be 10% to prepare a main component solution of the near infrared ray shielding film. To 100 g of the main component solution, nickel, 5.6 mg of bis-1,2-diphenyl-1,2-ethenedithiolate ("MIR101", tradename, manufactured by Midori Kagaku Co., Ltd.), a phthalocyanine type colorant ("EX color 801K", tradename, manufactured by NIPPON KAYAKU CO., LTD.), 22.4 mg of a diimmonium type colorant ("IRG022", tradename, manufactured by NIPPON KAYAKU CO., LTD.) and 0.4 mg of an anthraquinone type colorant (colorant A, manufactured by Dainichiseika Color & Chemicals Mfg. Co., Ltd.) were dissolved, and a polyethylene terephthalate film having a thickness of 150 $\mu$m (manufactured by Toyobo Co., Ltd.) was coated with the obtained solution by gravure coating to obtain a near infrared ray shielding film. The thickness of the near infrared ray shielding film including the polyethylene terephthalate film as the substrate was 153 $\mu$m.

Then, to the near infrared ray shielding film, an antireflection film ("ARCTOP URP2179", tradename, manufactured by Asahi Glass Company, Limited) was bonded by means of a roll laminating machine, and the near infrared ray shielding film and the antireflection film on the Ag paste were cut with a laser cutter and separated to form an electrode, and a front protective plate was obtained.

Integration of PDP Main Body and Front Protective Plate

The front protective plate prepared as mentioned above and a PDP main body were integrated in the same manner as in Example 1. The breaking test was carried out in the same method as in Example 1, and the stress was 6.8 MPa and the distortion was 3 mm when the PDP main body was broken.

REFERENCE EXAMPLE 1

The near infrared ray shielding film used in Example 5 was subjected to a heat deterioration resistance test by the following method.

Namely, optical properties were measured with regard to the near infrared ray shielding film before heating, after heating at 40° C. for 1,000 hours and after heating at 80° C. for 1,000 hours. Using an electric over as a heating means, the optical properties were evaluated by measuring the luminous average transmittance (unit: %) measured by means of a spectrophotometer (UV3100, manufactured by Shimadzu Corporation), the transmission color tone and the near infrared ray transmittance (unit: %). The results are shown in the following Table 2. In Table 2, the luminous average transmittance is a luminous average transmittance of visible light (wavelength: 380 to 780 nm), and obtained by subjecting the spectral distribution obtained by means of the spectrophotometer to geometric average by means of spectral luminous efficiency. The transmission color tone is obtained by representing the spectral distribution by values of coordinates (x coordinate and y coordinate) on the chromaticity diagram of CIE (International Commission on Illumination). The near infrared ray transmittance is represented by the transmittance at a wavelength of 850 nm and the transmittance at a wavelength of 900 nm.

TABLE 2

| Heating conditions | Luminous average transmittance (%) | Transmission color tone x | Transmission color tone y | Near infrared ray transmittance 850 nm | Near infrared ray transmittance 900 nm |
|---|---|---|---|---|---|
| Initial values | 72.5 | 0.314 | 0.322 | 12.60 | 8.72 |
| 40° C., 1,000 hr | 72.5 | 0.315 | 0.324 | 13.56 | 9.51 |
| 80° C., 1,000 hr | 73.2 | 0.318 | 0.331 | 16.32 | 12.61 |

It is confirmed from the results shown in Table 2 that with respect to the near infrared ray shielding film used in Example 5, all of the luminous average transmittance, the transmission color tone and the near infrared ray transmittance significantly deteriorated due to heating at 80° C. for 1,000 hours, as compared with the initial state before the heating. For example, as properties of a near infrared ray shielding filter, a transmittance at a wavelength of 850 nm of as most 15% and a transmittance at a wavelength of 900 nm of at most 10% are usually required, however, after the heating at 80° C. for 1,000 hours, the near infrared ray shielding effect deteriorated so that the above requirements could not be satisfied.

Whereas, after heating at 40° C. for 1,000 hours, deterioration of the near infrared ray transmittance was small, and the luminance transmittance and the transmission color tone did not substantially deteriorate.

TEST EXAMPLE 1

Using as a sample a front protective plate/PDP main body integrated product (PDP) prepared in the same manner as in Example 5, lighting was conducted for 1,000 hours in total and the heat deterioration resistance test was carried out. Measurement of the optical properties was carried out in the same manner as in Reference Example 1. However, in order that the front protective plate was taken out from the PDP main body to measure the optical properties after completion of the lighting, the front protective plate and the PDP main body were temporarily bonded by means of an adhesive, differently from Example 5.

Further, in order to examine the initial values before lighting, optical properties were measured in the same manner as in Reference Example 1 also with regard to the front protective plate before bonded to the PDP main body.

The results are shown in Table 3.

COMPARATIVE EXAMPLE 3

A front protective plate was prepared in the same manner as in Example 5 except that the near infrared ray shielding film was provided on the PDP main body side of the glass transparent substrate.

Namely, in the same manner as in Example 5, a Ag paste was formed on a tempered glass, and a multilayer film comprising 3Al—ZnO (40 nm)/1.0Pd—Ag (10 nm)/3Al—ZnO (80 nm)/1.0Pd—Ag (12 nm)/3Al—ZnO (80 nm)/1.0Pd—Ag (10 nm)/3Al—ZnO (40 nm) was formed thereon.

Then, on the side where the film by sputtering was formed, an antireflection layer ("ARCTOP URP2179", tradename, manufactured by Asahi Glass Company, Limited) was bonded by means of a roll laminating machine, and then the antireflection layer on the Ag paste was cut with a laser cutter and separated to form an electrode.

On the other hand, on the side of the glass plate opposite to the side where the film by sputtering was formed, the same near infrared ray shielding film as in Example 5 was bonded by means of a roll laminating machine to obtain a front protective plate.

COMPARATIVE TEST EXAMPLE 1

The front protective plate prepared in Comparative Example 3 and a PDP main body were temporarily fixed by means of an adhesive, and the obtained integrated product (PDP) was subjected to lighting for 1,000 hours in total, and the heat deterioration resistance test was carried out. Measurement of the optical properties was carried out in the same manner as in Reference Example 1.

Further, to examine the initial values before lighting, the optical properties were measured in the same manner as in Reference Example 1 also with respect to the front protective plate before bonded to the PDP main body, i.e. the front protective plate prepared in Comparative Example 3.

The results are shown in the following Table 3.

TABLE 3

| | Heating conditions | Luminous average transmittance (%) | Transmission color tone x | Transmission color tone y | Near infrared ray transmittance 850 nm | Near infrared ray transmittance 900 nm |
|---|---|---|---|---|---|---|
| Test Example 1 | (Initial values) | 50.5 | 0.298 | 0.302 | 8.30 | 5.70 |
| | After lighting for 1,000 hrs | 50.8 | 0.300 | 0.305 | 8.60 | 6.40 |
| Comparative Test Example 1 | (Initial values) | 50.5 | 0.298 | 0.302 | 8.30 | 5.70 |
| | After lighting for 1,000 hrs | 51.6 | 0.304 | 0.312 | 10.60 | 7.80 |

As evident from the results shown in Table 3, in Comparative Test Example 1, the luminous average transmittance increased so much as 1.1% after lighting of 1,000 hours, and with respect to the near infrared ray transmittance, the transmittances at a wavelength of 850 nm and at a wavelength of 900 nm increased so much as 2.3% and 2.1%, respectively, whereas in Test Example 1, the increase in the luminance average transmittance was so small as 0.3% and the increases in the transmittances at a wavelength of 850 nm and at a wavelength of 900 nm were so small as 0.3% and 0.7%, respectively. Further, with respect to the transmission color tone, in Comparative Test Example 1, the x value and y value increased by 0.006 and 0.010, respectively, after lighting of 1,000 hours, whereas in Test Example 1, the x value and y value increased only by 0.002 and 0.003, respectively. Accordingly, it was confirmed that deterioration of the optical properties was suppressed in Test Example 1.

As explained above, according to the present invention, by employing such a construction that a transparent substrate and a glass plate constituting the viewer's side surface of a flat display panel are bonded by means of an adhesive layer, the reflection on the interface can significantly be reduced, and a double image due to reflection of an external object can be minimized, as compared with a case where a protective plate is disposed on the surface side of a flat display panel main body with an air gap.

Further, in a case where a near infrared ray shielding layer containing a near infrared ray absorbent is present, a flat display panel having good stability of the near infrared ray shielding effect and a high reliability, even when the surface temperature of a flat display panel main body increases, can be obtained.

Further, when a front protective plate having a transparent substrate having an elastic modulus in bending at 23° C. of at least 2,000 MPa, such as a tempered glass, a semi-tempered glass or a highly rigid plastic, is unitedly bonded to the viewer's side surface of a flat display panel main body, and a glass plate constituting the surface of the flat display panel main body and the transparent substrate are bonded by means of an adhesive layer, an external force applied from the viewer's side can be supported by both the transparent substrate and the glass plate of the flat display panel main body, and an extremely high rigidity is imparted to the viewer's side of the flat display panel, whereby a flat display panel which is hardly broken, can be provided.

The entire disclosures of Japanese Patent Application No. 2001-221794 filed on Jul. 23, 2001 and Japanese Patent Application No. 2001-245176 filed on Aug. 13, 2001 including specifications, claims, drawings and summaries are incorporated herein by reference in their entireties.

What is claimed is:

1. A flat display panel, comprising:

a flat display panel main body having a viewer's side and an opposite side, and a front protective plate which comprises a transparent substrate having a first and second side, an electromagnetic wave shielding layer laminated to the second side of said transparent substrate, a near infrared ray shielding layer containing a near infrared ray absorbent, provided on the first side of the transparent substrate, and an adhesive layer provided as the outermost layer on the second side of the transparent substrate and bonded to the viewer's side surface of the flat display panel main body.

2. The flat display panel according to claim 1, wherein the front protective plate further comprises:

an antireflection layer provided as the outermost layer on said first side of the transparent substrate.

3. The flat display panel according to claim 2, wherein the flat display panel main body is a plasma display panel.

4. The flat display panel according to claim 1, wherein the flat display panel main body is a plasma display panel.

5. A flat display panel, comprising:

a flat display panel main body having a viewer's side and an opposite side, and a front protective plate which comprises a highly rigid transparent substrate having a first and second side and having an elastic modulus in bending of at least 2,000 MPa at 23° C., an electromagnetic wave shielding layer laminated to the second side of said transparent substrate, a near infrared ray shielding layer containing a near infrared ray absorbent, provided on the first side of the highly rigid transparent substrate, and an adhesive layer provided as the outermost layer on the second side of the highly rigid transparent substrate and bonded to the viewer's side surface of the flat display panel main body.

6. The flat display panel according to claim 5, wherein the front protective plate comprises:

an antireflection layer provided as the outermost layer on said first side of the transparent substrate.

7. The flat display panel according to claim 6, wherein the flat display panel main body is a plasma display panel.

8. The flat display panel according to claim 5, wherein the flat display panel main body is a plasma display panel.

9. A flat display panel, comprising:

a flat display panel main body having a viewer's side and an opposite side, and a front protective plate which comprises a transparent substrate comprising glass and having a first and second side, an electromagnetic wave shielding layer laminated to the second side of said transparent substrate, a near infrared ray shielding layer containing a near infrared ray absorbent, provided on the first side of the transparent substrate, and an adhesive layer provided as the outermost layer on the second side of the transparent substrate, bonded to the viewer's side surface of the flat display panel main body.

10. The flat display panel according to claim 9, wherein the front protective plate comprises:

an antireflection layer provided as the outermost layer on said first side of the transparent substrate.

11. The flat display panel according to claim 10, wherein the flat display panel main body is a plasma display panel.

12. The flat display panel according to claim 9, wherein the flat display panel main body is a plasma display panel.

* * * * *